US006682815B2

(12) United States Patent
Koyanagi et al.

(10) Patent No.: US 6,682,815 B2
(45) Date of Patent: Jan. 27, 2004

(54) STRETCHED YARN PIRN

(75) Inventors: Tadashi Koyanagi, Nobeoka (JP); Takao Abe, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/220,766

(22) PCT Filed: Mar. 16, 2001

(86) PCT No.: PCT/JP01/02133

§ 371 (c)(1),
(2), (4) Date: Sep. 5, 2002

(87) PCT Pub. No.: WO01/68498

PCT Pub. Date: Sep. 20, 2001

(65) Prior Publication Data

US 2003/0059611 A1 Mar. 27, 2003

(30) Foreign Application Priority Data

Mar. 17, 2000 (JP) ..... 2000-75178

(51) Int. Cl.[7] ..... D01F 6/00

(52) U.S. Cl. ..... 428/364; 428/395; 206/392; 264/210.5; 264/211.14

(58) Field of Search ..... 206/392; 428/364, 428/395; 264/130, 210.3, 211.14

(56) References Cited

U.S. PATENT DOCUMENTS

| | | | | |
|---|---|---|---|---|
| 6,495,254 | B1 * | 12/2002 | Abe et al. | 428/364 |
| 6,555,220 | B1 * | 4/2003 | Koyanagi et al. | 428/364 |
| 6,572,967 | B1 * | 6/2003 | Abe et al. | 428/395 |

FOREIGN PATENT DOCUMENTS

| | | |
|---|---|---|
| JP | 4-106073 | 4/1992 |
| JP | 9-175733 | 7/1997 |
| JP | 2000-73230 | 3/2000 |
| WO | WO 96/00808 | 1/1996 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

The invention provides a poly(trimethylene terephthalate) drawn yarn pirn. The drawn yarn pirn of the invention comprises poly(trimethylene terephthalate) drawn yarn having an intrinsic viscosity of 0.7–1.3 dl/g, a heat shrinkage stress-exhibiting initial temperature of 55° C. or higher, a heat shrinkage stress extreme temperature of 150–190° C. and a breaking elongation of 36–60%, wound at a wound hardness of 80–90. The drawn yarn pirn of the invention exhibits satisfactory reelability even with high-speed false twisting, as well as minimal yarn breakage and fluff generation, thereby giving a textured yarn with satisfactory quality.

8 Claims, 4 Drawing Sheets

STRETCHED YARN PIRN

TECHNICAL FIELD

The present invention relates to a drawn yarn pirn of poly(trimethylene terephthalate) (hereinafter abbreviated as "PTT") fiber and to a process for its production.

BACKGROUND ART

Poly(ethylene terephthalate) (hereinafter abbreviated as "PET") fiber is mass produced throughout the world as a most suitable synthetic fiber for clothing and constitutes the basis of a major worldwide industry.

PTT fiber is also known from prior art literature such as (A) J. Polymer Science: Polymer Physics Edition Vol.14, p.263–274(1976), (B) Chemical Fibers International, Vol.45, April (1995), p.110–111, (C) Japanese Unexamined Patent Publication SHO No. 52-5320, (D) Japanese Unexamined Patent Publication SHO No. 52-8123, (E) Japanese Unexamined Patent Publication SHO No. 52-8124 and (F) WO99/27168.

The aforementioned prior art documents (A) and (B) describe the basic stress-elongation properties of PTT fiber, suggesting that PTT fiber, due to its low initial modulus and excellent elastic recovery, is suited for uses such as clothing and carpets. Prior art documents (C), (D) and (E) propose methods for further improving the aforementioned characteristics of PTT fiber, by imparting satisfactory thermal dimensional stability in order to provide even better elastic recovery. Prior art document (F) proposes PTT fiber obtained by a continuous spinning/drawing process, to give a PTT fiber with suitable breaking elongation, thermal stress and boiling water shrinkage, which can exhibit a low modulus and a soft feel when used in knitted fabrics. It is disclosed that such PTT fiber is suitable for clothing, including under wear, outer wear, sportswear, legwear, linings, swimwear and the like.

DISCLOSURE OF THE INVENTION

In known methods for conventional production of synthetic fibers such as polyamide or polyester, a polymer is melt spun and wound up as undrawn yarn, after which the undrawn yarn is stretched and wound up into a cheese or pirn. The drawn yarn pirn wound with this two-stage system is either directly supplied to make a knitted fabric, or else is supplied to prepare a knitted fabric after false twisting in order to impart bulk or stretchability to the fabric.

The false twisting of the drawn yarn pirn is hampered by reeling of the drawn yarn from the pirn, or yarn breakage during false twisting, and therefore pirn false twisting methods which have been employed have a maximum working speed of 100 m/min.

Recently, however, in order to reduce working costs, demand has increased for pirn false twisting methods which accomplish working at 150 m/min or greater, and even high-speed false twisting methods at 200–500 m/min using disks or belts.

Investigation by the present inventors has confirmed that, unlike hitherto employed false twisting of PET fiber, high-speed false twisting from pirns of PTT fiber drawn yarn (hereinafter also referred to as "PTT drawn yarn") involves the problems of (a) reeling breakage (yarn breakage occurring during reeling) and (b) false twisting heater breakage (yarn breakage occurring due to the false twisting heater).

(a) Reeling Breakage

With PTT fiber, the stretching stress during drawing remains as contractile force after winding on the drawn yarn pirn, such that the drawn yarn pirn remains tightly rolled.

A tightly rolled drawn yarn pirn has an increased wound hardness, and when it is attempted to reel drawn yarn from such a drawn yarn pirn, the reeling tension is significantly altered in the direction of the yarn length, often generating an inordinately high tension and producing reeling breakage.

(b) False Twisting Heater Breakage

PTT fiber has a very narrow suitable false twisting temperature range compared to PET fiber, and the heater temperature must therefore be adjusted to 150–180° C. If the heater temperature is below 150° C., the crimping performance of the textured yarn is inferior, for example, crimping of the resulting worked fiber flows in the knitting or dyeing step, and the textured yarn thus cannot withstand practical use. On the other hand, a heater temperature of higher than 180° C. causes yarn breakage on the heater.

In order to obtain PTT fiber with satisfactory false twisting workability, therefore, the heat shrinkage properties of the drawn yarn wound on the pirn supplied to the false twisting step must be carefully selected.

This problem involved with false twisting of PTT fiber was unpredictable with PET fiber, and only became apparent as a result of research by the present inventors. The aforementioned prior art documents (A) to (F) therefore neither describe nor disclose this practical problem encountered with false twisting.

It is an object of the present invention to provide a PTT drawn yarn pirn with satisfactory reelability and minimal false twisting breakage or textured yarn fluff generation which occur when false twisting is carried out at high speed.

It is another object to provide a PTT drawn yarn pirn with excellent high-speed false twistability, which is obtained by a two-stage process.

More specifically, the invention provides a PTT drawn yarn pirn with satisfactory reelability even with high-speed false twisting, and with no yarn breakage or fluff generation during texturing even at high heater temperatures, thus resulting in textured yarn of satisfactory quality, as well as a process for its production.

As a result of diligent research aimed at solving the problems described above, the present inventors have completed the present invention upon finding that by prescribing ranges for the drawn yarn heat shrinkage properties and wound hardness, and for the winding shape, it is possible to obtain a drawn yarn pirn without reeling breakage or false twisting breakage but having excellent high-speed false twistability. It was also found that the drawn yarn pirn is preferably obtained under specific drawing conditions and aging conditions of the drawn yarn.

In other words, the present invention provides the following.

1) A drawn yarn pirn characterized in that PTT drawn yarn composed of at least 95 mole percent of a trimethylene terephthalate repeating unit and no greater than 5 mole percent of another ester repeating unit, having an intrinsic viscosity of 0.7–1.3 dl/g and satisfying the following conditions (1) to (3), is wound at a wound hardness of 80–90.

(1) A heat shrinkage stress-exhibiting initial temperature of 55° C. or higher (2) A heat shrinkage stress extreme temperature of 150–190° C.

(3) A breaking elongation of 36–60%.

2) A drawn yarn pirn according to 1) above, wherein the breaking elongation of the drawn yarn is 43–60%.

3) A drawn yarn pirn according to 2) above, characterized in that the heat shrinkage stress-exhibiting initial temperature of the drawn yarn is 60–80° C. and the extreme temperature is 155–170° C.

4) A drawn yarn pirn according to 1) above, characterized in that the heat shrinkage extreme stress of the drawn yarn is 0.13–0.21 cN/dtex, and the drawn yarn is wound at a winding angle of 15–21°.

5) A drawn yarn pirn according to 4) above, wherein the breaking elongation of the drawn yarn is 43–60%.

6) A drawn yarn pirn according to 5) above, characterized in that the heat shrinkage stress-exhibiting initial temperature of the drawn yarn is 60–80° C. and the extreme temperature is 155–170° C.

7) A process for producing a drawn yarn pirn characterized in that undrawn yarn made of PTT composed of at least 95 mole percent of a trimethylene terephthalate repeating unit and no greater than 5 mole percent of another ester repeating unit and having an intrinsic viscosity of 0.7–1.3 dl/g is first wound and then drawn to produce a drawn yarn pirn, the process satisfying the following conditions (1) to (3).

(1) The drawing tension is 0.20–0.30 cN/dtex (2) The ballooning tension during winding of the pirn is 0.03–0.20 cN/dtex (3) The drawn yarn is aged for at least 10 days in an atmosphere at 25–45° C.

8) A process for producing a drawn yarn pirn according to 7) above, characterized in that the relaxation during winding of the pirn is 2–5%.

DETAILED DESCRIPTION OF THE INVENTION

Figure 1:
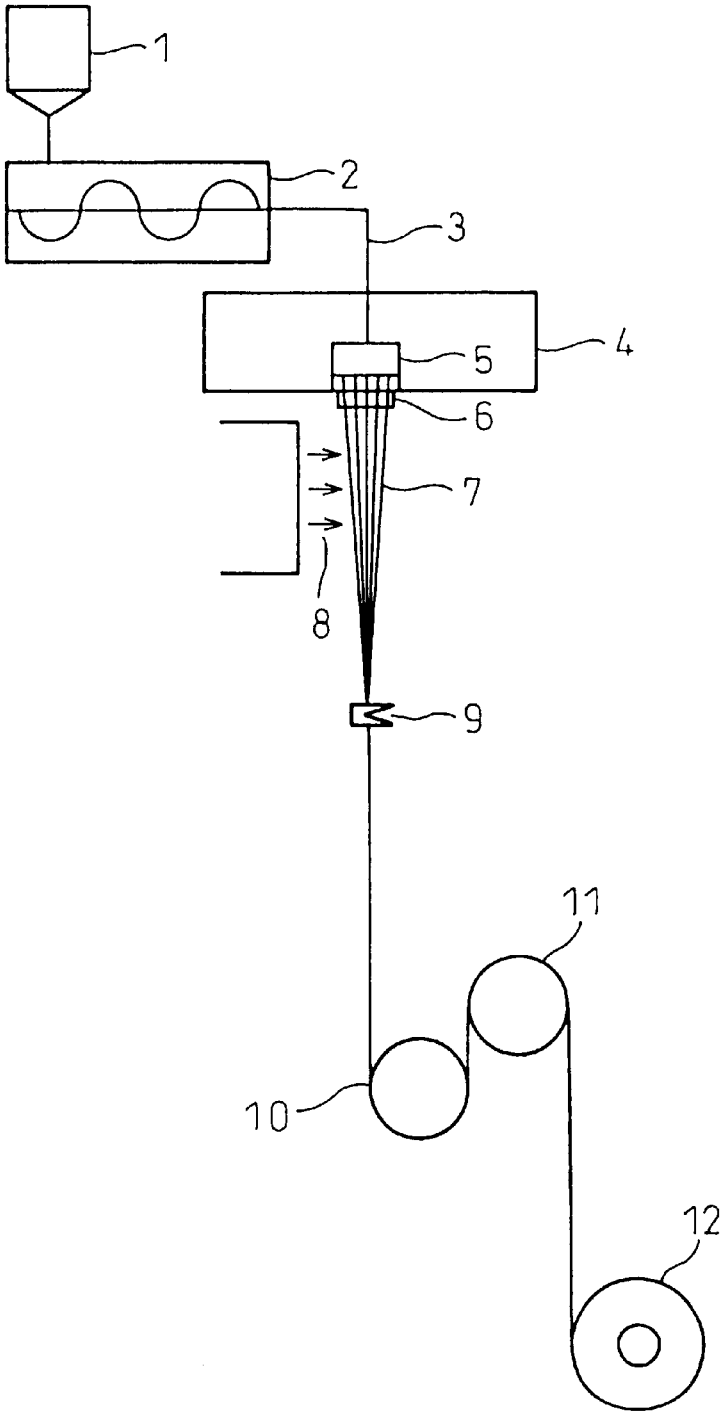
FIG. 1 is a schematic diagram showing an embodiment of a spinning machine which produces undrawn yarn, used for the drawn yarn pirn production process of the invention.

The drawn yarn pirn of the invention has a heat shrinkage stress-exhibiting initial temperature of 55° C. or higher. The heat shrinkage stress of PTT drawn yarn is measured by the thermal stress measuring device described below.

When measurement is initiated from room temperature, heat shrinkage stress usually begins to be exhibited at 40–50° C. with conventional PTT drawn yarn. In contrast, the stress-exhibiting initial temperature is 55° C. or higher according to the invention. With a stress-exhibiting initial temperature of below 55° C., yarn breakage and fluff become abundant when the false twisting heater temperature is over 150° C. With a stress-exhibiting initial temperature of 55° C. or above, stable false twisting can be accomplished even when the false twisting heater temperature is 150–180° C. A higher stress-exhibiting initial temperature is preferred, but from the standpoint of wound shape stability during aging, it is preferably 60–80° C., more preferably 65–80° C. and even more preferably 70–80° C.

The drawn yarn pirn of the invention has a heat shrinkage stress extreme temperature of 150–190° C. for PTT drawn yarn measured by the method described below. With a heat shrinkage stress extreme temperature of below 150° C., slack is produced in the drawn yarn on the heater if the false twisting heater temperature is 150° C. or above, thus complicating stable texturing. In order to achieve stable texturing, the heat shrinkage stress extreme temperature is preferably 155° C. or higher, and more preferably 160° C. or higher. From the standpoint of controlling yarn breakage and fluff caused by the heat treatment during drawing, the heat shrinkage stress extreme temperature should be no higher than 190° C., and preferably 155–170° C.

From the standpoint of eliminating yarn breakage during high-speed false twisting, the drawn yarn pirn of the invention preferably has a heat shrinkage extreme stress of 0.13–0.21 cN/dtex for PTT drawn yarn as measured by the method described below.

The drawn yarn pirn of the invention has a breaking elongation of 36–60% for PTT drawn yarn. If the breaking elongation is less than 36%, false twisting breakage occurs when the false twisting heater temperature is 150° C. or above.

This major effect of breaking elongation on the suitable false twisting temperature range has hardly been seen with PET fiber, and is a phenomenon characteristic to PTT fiber. The fact that the aforementioned suitable range exists for the breaking elongation of PTT drawn yarn could never have been expected based on knowledge of the false twisting property of PET fiber.

A greater breaking elongation is preferred to allow texturing at a higher false twisting heater temperature. However, if the breaking elongation exceeds 60%, size spots are produced in the PTT drawn yarn, and these remain as dyeing spots even after false twisting, thereby impairing the quality of the textured yarn. The breaking elongation is preferably 43–60%, and more preferably 45–55%.

The drawn yarn pirn of the invention is obtained by winding the PTT drawn yarn into a pirn shape to a wound hardness of 80–90. The wound hardness is the value measured with a Vickers hardness tester described below, and a smaller value indicates a lower winding density. While ordinary pirns are wound at a wound hardness of over 90, the pirn of the invention is wound at a low density. By winding into a pirn with a low density, it may be possible to relieve the drawing stress accumulated during drawing, without inhibiting the reelability of the drawn yarn by wound tension even when the pirn is at rest for long periods, and to obtain a drawn yarn with excellent thermal stress properties. When the wound hardness is less than 80, problems may occur such as collapse of the shape during handling, which includes transport. The preferred wound hardness is 82–88.

Figure 4:
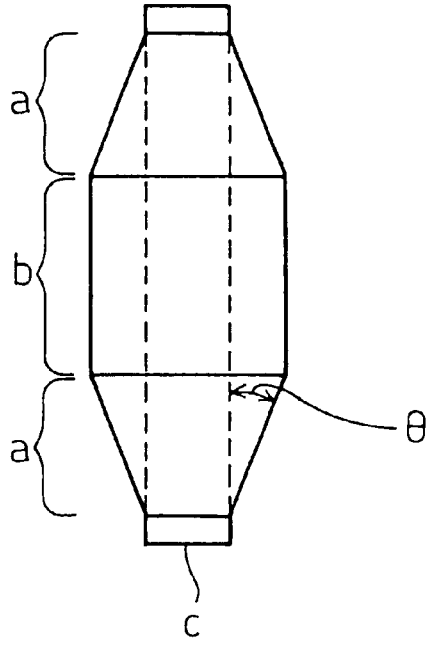
FIG. 4 is a schematic drawing showing an embodiment of a drawn yarn pirn according to the invention.

An embodiment of a drawn yarn pirn of the invention is shown in FIG. 4. In FIG. 4, (a) is the pirn taper section, (b) is the pirn cylinder, (c) is the pirn support and θ is the angle of the pirn taper section with respect to the pirn support.

The drawn yarn pirn of the invention preferably is wound at a winding angle of 15–21° for PTT drawn yarn, in order to achieve satisfactory reelability for reeling at high speed. The winding angle is the angle θ of the pirn taper section (a) with respect to the pirn support (c) in the schematic drawing of the drawn yarn pirn in FIG. 4. A winding angle of 15–21° is very small compared to conventional publicly known PET drawn yarn pirns which are wound at a winding angle of 23–25°. When the winding angle is less than 15°, the wound mass of the pirn is less than about 1 kg, which is economically undesirable. When the winding angle is greater than 21°, the winding becomes disordered during winding of the pirn or during its subsequent handling, sometimes making it difficult to maintain a stable pirn shape. A more preferred winding angle is 18–20. For a PTT drawn yarn pirn, it is expected that the winding angle will have a major effect on the reelability, owing to properties such as smoothness or elastic recovery of the PTT drawn yarn.

According to the invention, the size and denier of the PTT drawn yarn are not particularly restricted, but the yarn size is preferably 20–300 dtex and the single filament size is preferably 0.5–20 dtex.

The PTT drawn yarn may also contain a commonly used finishing agent at 0.2–2 wt % for the purpose of imparting smoothness, convergence, electrostatic properties and the like.

Filament crossing may also be imparted at up to 50 nodes/m for the purpose of improving the reelability or convergence during false twisting.

According to the invention, the PTT polymer composing the PTT drawn yarn comprises at least 95 mole percent of a trimethylene terephthalate repeating unit, while the remaining 5 mole percent or less consists of another ester repeating unit. That is, as PTT polymers there are included PTT homopolymer and PTT copolymers containing up to 5 mole percent of another ester repeating unit.

The following may be mentioned as typical copolymerization components.

Acid components include aromatic dicarboxylic acids, typical of which are isophthalic acid and 5-sodiumsulfoisophthalic acid, and aliphatic dicarboxylic acids, typical of which are adipic acid and itaconic acid. Glycol components include ethylene glycol, butylene glycol, poly(ethylene glycol) and the like. Other components include hydroxycarboxylic acids such as hydroxybenzoic acid. More than one of these may also be copolymerized.

So long as the effect of the invention is not impeded, the PTT drawn yarn may also contain additives, optionally as copolymerization components, including delustering agents such as titanium oxide, heat stabilizers, antioxidants, antistatic agents, ultraviolet absorbers, antibacterial agents and various pigments.

The intrinsic viscosity of the PTT drawn yarn of the invention is in the range of 0.7–1.3 dl/g and preferably 0.8–1.1 dl/g, from the standpoint of drawn yarn strength and yarn breakage during spinning and drawing.

The process for production of the PTT polymer of the invention may be any publicly known process, and a typical example thereof is a two-stage process wherein the polymerization degree is increased by melt polymerization to a certain intrinsic viscosity, and then the polymerization degree is further increased by solid phase polymerization to correspond to the intrinsic viscosity.

The PTT drawn yarn pirn of the invention may be suitably obtained by first winding up undrawn yarn made of PTT composed of at least 95 mole percent of a trimethylene terephthalate repeating unit and no greater than 5 mole percent of another ester repeating unit and having an intrinsic viscosity of 0.7–1.3 dl/g, and then drawing to produce a drawn yarn pirn, the process satisfying the following conditions (1) to (3).

(1) The drawing tension is 0.20–0.30 cN/dtex (2) The ballooning tension during winding of the pirn is 0.03–0.20 cN/dtex (3) The drawn yarn is aged for at least 10 days in an atmosphere at 20° C. or above, and preferably 25–45° C.

Figure 2:
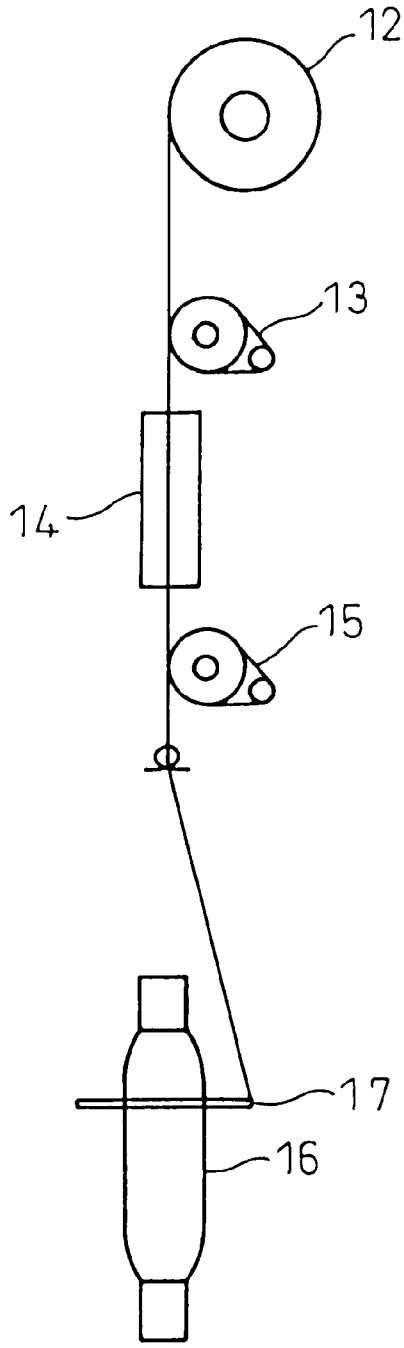
FIG. 2 is a schematic diagram showing an embodiment of a drawing machine used for the drawn yarn pirn production process of the invention.
Figure 3:
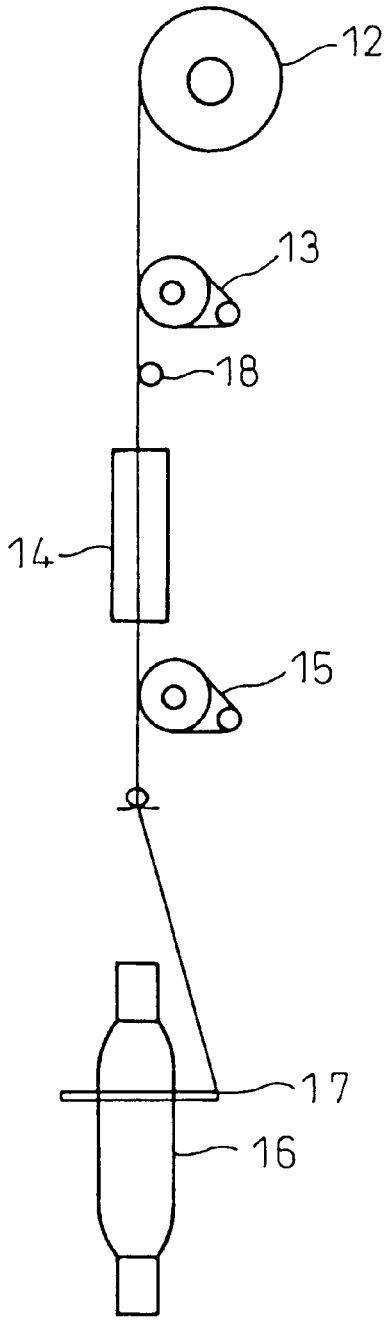
FIG. 3 is a schematic diagram showing an embodiment of a drawing machine employing a drawing pin, used for the drawn yarn pirn production process of the invention.

An example of the production process for a PTT drawn yarn pirn of the invention will now be explained in detail with reference to FIGS. 1 to 3. In FIGS. 1, 2 and 3, 1 is a polymer pellet drier, 2 is an extruder, 3 is a bend, 4 is a spin head, 5 is a spin pack, 6 is a spinneret, 7 is a multifilament, 8 is cooling air, 9 is a finishing agent-coating apparatus, 10 is a godet roller, 11 is a godet roller, 12 is an undrawn yarn package, 13 is a supply roll, 14 is a hot plate, 15 is a drawing roll, 16 is a drawn yarn pirn, 17 is a traveler guide and 18 is a drawing pin.

As shown in FIG. 1, first, PTT pellets dried to a moisture content of 30 ppm or less with a drier 1 are supplied to an extruder 2 set to a temperature of 255–265° C. for melting. The molten PTT then passes through a bend 3 and is sent to a spin head 4 set to 250–265° C., and dispensed with a gear pump. It is then passed through a spinneret 6 having a plurality of ports which is mounted on a spin pack 5, and extruded into a spinning chamber as a multifilament 7. The temperatures of the extruder 2 and spin head 4 are appropriately selected in the ranges mentioned above depending on the intrinsic viscosity and shape of the PTT pellets.

The PTT multifilament 7 extruded into the spinning chamber is cooled to room temperature by cooling air 8 while being thinned and solidified by rollers 10, 11 rotating at a prescribed speed, and is wound up as an undrawn yarn package 12 of the prescribed size. The undrawn yarn is coated with a finishing agent by a finishing agent-coating apparatus 9 before contacting the take-up godet roller 10, and is wound up as an undrawn yarn package after leaving the take-up godet roller 11.

According to the production process of the invention, the finishing agent used to coat the undrawn yarn is preferably an aqueous emulsion type. The concentration of the finishing agent aqueous emulsion is preferably 15 wt % or greater and more preferably 20–35 wt %.

The winding speed for production of the undrawn yarn is preferably no greater than 3000 m/min. More preferably, the winding speed is 1000–2000 m/min, and more preferably it is 1200–1800 m/min.

The undrawn yarn is then supplied to a drawing step and drawn with a drawing machine, as shown in FIG. 2 or FIG. 3. The storage environment for the undrawn yarn until supply to the drawing step is preferably kept at an atmospheric temperature of 10–25° C. and a relative humidity of 75–100%. The undrawn fiber on the drawing machine is preferably kept at this temperature and humidity throughout the drawing.

At the drawing machine, as shown in FIG. 2, first the undrawn yarn package 12 is heated on a supply roll 13 set to 45–65° C., and the peripheral speed ratio between the supply roll 13 and drawing roll 15 is utilized for drawing to the prescribed size. After or during the drawing, the fiber is conveyed while contacting a hot plate 14 set to 100–150° C., for tension heat treatment. The fiber which has left the drawing roll 15 is twisted with a spindle while being wound up as a drawn yarn pirn 16. The temperature of the supply roll 13 is preferably 50–60° C. and more preferably 52–58° C.

The speed ratio between the supply roll 13 and the drawing roll 15 (i.e. the drawing ratio) and the hot plate temperature are set so as to give a drawing tension of 0.2–0.30 cN/dtex. If the drawing tension is less than 0.2 cN/dtex, the drawn yarn breaking elongation exceeds 60%, making it impossible to achieve the object of the invention. Also, if the drawing tension is greater than 0.30 cN/dtex, the resulting drawn yarn breaking elongation is less than 36%, making it impossible to achieve the object of the invention.

For the drawing step, the drawing may be carried out using a drawing machine such as shown in FIG. 3, if necessary. The drawing machine shown in FIG. 3 is provided with a drawing pin 18 between the supply roll 13 and hot plate 14. In this case, the temperature of the supply roll 13 is preferably controlled as strictly as possible to preferably 50–60° C. and more preferably 52–58° C.

The drawn yarn leaving the drawing roll 15 is wound up into a drawn yarn pirn 16 while forming a balloon with a traveler guide 17. The ballooning tension here is the centrifugal force acting on the yarn due to rotation of the spindle, and it is determined by the mass of the drawn yarn, the mass of the traveler guide, and the rotation rate of the spindle holding the drawn yarn.

The ballooning tension in the production process of the invention is 0.03–0.20 cN/dtex. If the ballooning tension is greater than 0.20 cN/dtex, the wound density of the drawn yarn pirn increases resulting in insufficient relaxation of the drawn yarn in the pirn, thereby making it difficult to obtain yarn with a heat shrinkage stress-exhibiting initial temperature and extreme temperature within the ranges of the invention.

A lower ballooning tension is preferred, but at less than 0.03 cN/dtex, the pirn shape will often tend to become disordered. The preferred range for the ballooning tension is 0.05–0.17 cN/dtex.

In order to stably obtain such a low ballooning tension, the relaxation from the drawing roll 15 until winding into the pirn is preferably 2–5%. A relaxation within this range will give a ballooning tension of 0.03–0.20 cN/dtex and a wound hardness of 80–90. In the case of a conventional PET fiber, the relaxation is less than 1%.

The winding angle is set by adjusting the winding weight of the pirn and the traverse winding width of the drawing machine. Specifically, adjustment of the traverse winding width of the drawing machine is adjustment by the count input of a digital switch incorporated into the ring rail count control device of the drawing machine.

According to the production process of the invention, the drawn yarn produced under the specific conditions described above is aged for at least 10 days in an atmosphere at 25–45° C. Aging under such specific conditions allows the drawn yarn wound in the pirn at a low winding density to relax, without collapse of the wound shape of the drawn yarn pirn, thus resulting in drawn yarn having heat shrinkage properties as specified by the present invention and excellent false twistability. The aging atmosphere temperature and period is preferably 30–40° C. for 20 days or longer.

For false twisting of the drawn yarn, there may be employed commonly used pin type, friction type, nip-belt type or air false-twisting type methods. The false twisting heater may be a false twisting single-heater or a false twisting double-heater, but a false twisting single-heater is preferred to obtain high stretch properties.

The false twisting heater temperature is preferably set so that the yarn temperature immediately after leaving the first heater is preferably 130–200° C., more preferably 150–180° C. and most preferably 160–180° C.

The stretching elongation of false twisted yarn obtained by a false twisting single-heater is preferably 100–300%, while the stretching elastic modulus is preferably 80% or greater.

If necessary, heat setting may be accomplished with a second heater, for double-heater false twisted yarn. The second heater temperature is preferably 100–210° C., and the yarn temperature is preferably in the range of −30° C. to +50° C. with respect to the yarn temperature immediately after leaving the first heater.

The overfeed ratio in the second heater (second overfeed ratio) is preferably +3% to +30%.

The present invention will now be explained in greater detail by way of examples, with the implicit understanding that the invention is in no way limited by the examples.

The measuring methods and evaluating methods were as follows.

(1) Intrinsic Viscosity

The intrinsic viscosity [η] (dl/g) is the value defined by the following formula.

$$[\eta]=lim(\eta r-1)/C \quad C\rightarrow 0$$

where ηr is the value of the viscosity of a diluted solution of the PTT polymer dissolved in o-chlorophenol at 98% purity or greater at 35° C., divided by the viscosity of the solvent measured at the same temperature, and it is defined as the relative viscosity. C is the polymer concentration (g/100 ml).

(2) Breaking Elongation

This was measured according to JIS-L-1013

(3) Heat Shrinkage Stress-Exhibiting Initial Temperature, Extreme Temperature and Extreme Stress These were measured using a Thermal Stress Measuring Apparatus (KE-2, trade name of Kanebo Engineering Co.). A drawn filament was cut out to a length of about 20 cm and both ends were linked to form a loop, which was mounted in the measuring apparatus. Measurement was conducted under conditions with an initial load of 0.044 cN/dtex and a temperature elevating rate of 100° C./min, and the heat shrinkage stress temperature change was recorded on a chart.

The stress-exhibiting initial temperature was read from the recorded chart as the temperature at which heat shrinkage stress began to be exhibited. The thermal shrinkage stress results as a bell curve in the high temperature region, and therefore the temperature of the peak value of the heat shrinkage stress was recorded as the extreme temperature while the peak value of the stress at that temperature was recorded as the extreme stress.

(4) Stretching Elongation and Stretching Elastic Modulus

These were measured according to JIS-L-1090, Stretching Properties Test Method (Method A).

(5) Drawing Tension

The drawing tension was determined using a ROTHSCHILD Mini Tens R-46 (product of Zellweger Uster) as the tensiometer, measuring the tension $T_1$ (cN) on a filament running near the heat treatment apparatus for the drawing step (for example, between the supply roll 13 and hot plate 14 in FIG. 2, or between the drawing pin 18 and hot plate 14 in FIG. 3), and dividing this by the drawn yarn size D (dtex).

$$\text{Drawing tension } (cN/dtex)=T_1/D$$

(6) Ballooning Tension

This was determined by measuring the tension $T_2$ (cN) on a balloon formed by the drawing roll 15 and traveler guide 17 in FIG. 3, for example, between the drawing roll and the pirn in the drawing step, in the same manner as for measurement of the drawing tension, and dividing this by the drawn yarn size D (dtex).

$$\text{Ballooning tension } (cN/dtex)=T_2/D$$

(7) Hardness

The hardness of the drawn yarn pirn was determined using a hardness tester (GC Type-A, product of Teclock Co., Ltd.), measuring the hardness at a total of 16 locations on the surface of the cylinder of the drawn yarn pirn (at 4 equal spacings in the vertical direction and 4 equal spacings every 90° in the circumferential direction), and taking the average value.

(8) Reelability and False Twisting Property

False twisting was carried out under the following conditions, and the number of yarn breaks per day with continuous false twisting with 144 spindles/stage was measured to evaluate the reelability and false twistability.

False twisting machine: 33H False Twister (belt-type) by Murata Machinery Co., Ltd.

False twisting conditions:

Filament speed: 500 m/min

False twisting turns: 3230 T/m

First heater feed rate: −1%

First heater temperature: 170° C.

1) Reelability

This was evaluated based on the following scale after counting the number of yarn breaks between the drawn yarn pirn and the feed roller entrance.

◎: Less than 10 yarn breaks/day/stage; very satisfactory

○: 10–30 yarn breaks/day/stage; satisfactory

×: More than 30 yarn breaks/day/stage; low industrial productivity

2) False Twistability

This was evaluated based on the following scale after counting the number of yarn breaks in the false twisting heater after the feed roller.

◎: Less than 10 yarn breaks/day/stage; very satisfactory

○: 10–30 yarn breaks/day/stage; satisfactory

×: More than 30 yarn breaks/day/stage; low industrial productivity (9) Textured Yarn Dye Quality The textured yarn dye quality was evaluated by panelists based on the following scale.

◎: Very satisfactory

○: Satisfactory

×: Unsatisfactory with dye lines

(10) Overall evaluation

The reelability, false twistability and textured yarn dye quality were judged overall according to the following scale.

◎: Very satisfactory reelability, false twistability and dye quality

○: Very satisfactory or satisfactory reelability, false twistability or dye quality, with no defects ×: Unsatisfactory reelability, false twistability or dye quality Examples 1–4, Comparative Examples 1 and 2

The effects of the ballooning tension and the drawn yarn heat shrinkage stress-exhibiting initial temperature on the texturability will now be explained by way of examples and comparative examples.

PTT pellets with an intrinsic viscosity of 0.91 dl/g containing 0.4 wt % titanium oxide were used to produce PTT drawn yarn with a spinning machine and drawing machine as shown in FIG. 1 and FIG. 3, at 84 dtex/36 filaments.

The spinning conditions and drawing conditions for the examples and comparative examples were as follows.

(Spinning Conditions)

Pellet drying temperature and final moisture content: 110° C., 25 ppm

Extruder temperature: 260° C.

Spin head temperature: 265° C.

Spinneret diameter: 0.40 mm

Polymer discharge volume: 28.0 g/min

Cooling air conditions: Temperature=22° C., relative humidity=90%, speed=0.5 m/sec Take-up speed: 1500 m/min (Undrawn Yarn)

Size: 131.1 dtex

Birefringence: 0.024 winding weight: 6.2 kg/bobbin (Drawing Conditions)

Drawing roll temperature: 55° C.

Drawing pin: present

Hot plate temperature: 130° C.

Drawing roll temperature: non-heated (room temperature)

Drawing ratio: 2.3

Drawing tension: 0.25 cN/dtex

Relaxation: 2.6%

Take-up speed: 800 m/min

Winding weight: 2.5 kg/pirn (Drawn Yarn)

Size: 83.2 dtex

Breaking strength: 3.5 cN/dtex

Breaking elongation: 45%

Boiling water shrinkage: 13.1%

Pirn winding angle: 19°

Pirn wound hardness: As shown in Table 1

The different ballooning tensions shown in Table 1 were produced by changing the traveler guide and spindle rotation rate for winding of the drawn yarn.

The resulting drawn yarn pirn was aged for 30 days in a thermostatic chamber at a temperature of 30° C. and a relative humidity of 65%.

Table 1 shows the physical properties of the aged drawn yarn and drawn yarn pirn, and the reelability and false twistability during false twisting.

(Physical Properties of False Twisted Yarn)

Size: 84.5 dtex

Breaking strength: 3.3 cN/dtex

Breaking elongation: 42%

Stretching elongation: 192%

Stretching elastic modulus: 88%

As clearly seen from Table 1, satisfactory reelability and false twistability were achieved when the ballooning tension was within the range of the invention. The dye quality of the obtained textured yarn was also spot-free and satisfactory. The crimping properties of the textured yarn were also acceptable.

When the ballooning tension was lower than the range of the invention, disordered winding of the pirn occurred, forcing termination of the drawing. On the other hand, when the ballooning tension was as high as 0.30 cN/dtex, the wound hardness was high, resulting in numerous reeling breaks and false twisting breaks.

Examples 5–8, Comparative Examples 3 and 4

The effects of the drawing tension and breaking elongation on the false twistability will now be explained by way of examples and comparative examples.

Spinning and drawing were carried out in the same manner as Example 1. However, the spinning conditions and drawing conditions for these examples and comparative examples were as follows.

(Spinning Conditions)

Pellet drying temperature and final moisture content: 110° C., 25 ppm

Extruder temperature: 260° C.

Spin head temperature: 265° C.

Spinneret diameter: 0.40 mm

Polymer discharge volume: Adjusted for a drawn yarn size of 84 dtex

Cooling air conditions: Temperature=22° C., relative humidity=90%, speed=0.5 m/sec Take-up speed: 1,500 m/min (Drawing Conditions)

Drawing roll temperature: 55° C.

Drawing pin: present

Hot plate temperature: 130° C.

Drawing roll temperature: non-heated (room temperature)

Drawing ratio: Adjusted for the drawing tension value shown in Table 2

Ballooning tension: 0.08 cN/dtex

Take-up speed: 800 m/min

Winding weight: 2.5 kg/pirn (Drawn Pirn)

Pirn winding angle: 19°

Pirn wound hardness: As shown in Table 2

For the drawing, the drafts were varied to give the drawing tensions shown in Table 2.

The resulting drawn yarn pirn was aged for 30 days in a thermostatic chamber at a temperature of 30° C. and a relative humidity of 65%, and then false twisted.

Table 2 shows the physical properties of the aged drawn yarn and drawn yarn pirn, and the reelability and false twistability during false twisting.

As clearly seen from Table 2, satisfactory reelability, false twistability and dye quality were achieved when the drawing tension was within the range of the invention.

When the drawing tension was higher than the range of the invention, the reelability and false twistability were unsatisfactory. On the other hand, when the drawing tension was lower than the range of the invention, the breaking elongation of the drawn yarn was high, and therefore despite satisfactory false twistability, the dye quality of the textured yarn was unsatisfactory.

Examples 9–12, Comparative Examples 5–7

The effects of the drawn yarn pirn aging conditions on the false twistability will now be explained by way of examples and comparative examples.

The drawn yarn obtained in Example 6 was aged in the same manner as Example 6, except that aging was carried out immediately after completion of drawing, under the conditions shown in Table 3.

Table 3 shows the physical properties of the aged drawn yarn and drawn yarn pirn, and the reelability and false twistability during false twisting.

As clearly seen from Table 3, satisfactory reelability and false twistability were achieved in the false twisting step when the aging conditions were within the range of the invention.

Examples 13 and 14

The effects of the drawn yarn pirn winding angle on the false twistability will now be explained by way of examples.

The same procedure was carried out as in Example 6, except that the drawn yarn pirn winding angle was varied as shown in Table 4, by adjusting the digital switch of the ring rail count control device of the drawing machine.

Table 4 shows the physical properties of the aged drawn yarn and drawn yarn pirn, and the reelability and false twistability during false twisting.

As clearly seen from Table 4, satisfactory false twistability was achieved when the drawn yarn pirn winding angle was within the range of the invention.

TABLE 1

| | Ballooning tension (cN/dtex) | Pirn wound hardness | Heat shrinkage stress: Stress-exhibiting initial temperature (° C.) | Heat shrinkage stress: Extreme temperature (° C.) | Heat shrinkage stress: Extreme stress (cN/dtex) | Reel-ability | False twist-ability | Textured yarn dye quality | Overall evaluation |
|---|---|---|---|---|---|---|---|---|---|
| Comp. Ex. 1 | 0.02 | Unmeasurable due to winding disorder | | | — | — | — | — | X |
| Example 1 | 0.05 | 80 | 75 | 164 | 0.19 | ◎ | ◎ | ◎ | ◎ |
| Example 2 | 0.10 | 82 | 70 | 162 | 0.19 | ◎ | ◎ | ◎ | ◎ |
| Example 3 | 0.12 | 83 | 68 | 160 | 0.20 | ◎ | ◎ | ◎ | ◎ |
| Example 4 | 0.17 | 85 | 62 | 155 | 0.21 | ○ | ◎ | ◎ | ○ |
| Comp. Ex. 2 | 0.30 | 92 | 49 | 147 | 0.22 | X | X | ○ | X |

TABLE 2

| | Drawing tension (cN/dtex) | Relax-ation (%) | Breaking elonga-tion (%) | Pirn wound hardness | Heat shrinkage stress: Stress-exhibiting initial temperature (° C.) | Heat shrinkage stress: Extreme temperature (° C.) | Heat shrinkage stress: Extreme stress (cN/dtex) | Reel-ability | False twist-ability | Textured yarn dye quality | Overall evaluation |
|---|---|---|---|---|---|---|---|---|---|---|---|
| Comp. Ex. 3 | 0.38 | 3.0 | 32 | 92 | 51 | 149 | 0.33 | X | X | ○ | X |
| Example 5 | 0.26 | 2.6 | 43 | 84 | 69 | 158 | 0.20 | ◎ | ◎ | ◎ | ◎ |
| Example 6 | 0.25 | 2.5 | 45 | 82 | 74 | 160 | 0.19 | ◎ | ◎ | ◎ | ◎ |
| Example 7 | 0.23 | 2.4 | 50 | 81 | 76 | 162 | 0.17 | ◎ | ◎ | ◎ | ◎ |

TABLE 2-continued

| | Drawing tension (cN/dtex) | Relaxation (%) | Breaking elongation (%) | Pirn wound hardness | Heat shrinkage stress: Stress-exhibiting initial temperature (° C.) | Heat shrinkage stress: Extreme temperature (° C.) | Heat shrinkage stress: Extreme stress (cN/dtex) | Reelability | False twistability | Textured yarn dye quality | Overall evaluation |
|---|---|---|---|---|---|---|---|---|---|---|---|
| Example 8 | 0.20 | 2.2 | 56 | 80 | 77 | 163 | 0.14 | ◎ | ◎ | ○ | ○ |
| Comp. Ex. 4 | 0.16 | 2.0 | 65 | 77 | 78 | 164 | 0.12 | ○ | ○ | X | X |

TABLE 3

| | Aging: Temperature (° C.) | Aging: Days | Heat shrinkage stress: Stress-exhibiting initial temperature (° C.) | Heat shrinkage stress: Extreme temperature (° C.) | Heat shrinkage stress: Extreme stress (cN/dtex) | Reelability | False twistability | Textured yarn dye quality | Overall evaluation |
|---|---|---|---|---|---|---|---|---|---|
| Comp. Ex. 5 | 15 | 1 | 49 | 145 | 0.22 | X | X | ○ | X |
| Comp. Ex. 6 | 15 | 10 | 52 | 146 | 0.22 | ○ | X | ○ | X |
| Comp. Ex. 7 | 15 | 20 | 53 | 147 | 0.22 | ○ | X | ○ | X |
| Example 9 | 25 | 10 | 62 | 152 | 0.21 | ◎ | ○ | ◎ | ○ |
| Example 10 | 30 | 20 | 64 | 155 | 0.20 | ◎ | ◎ | ◎ | ◎ |
| Example 11 | 35 | 10 | 72 | 158 | 0.19 | ◎ | ◎ | ◎ | ◎ |
| Example 12 | 35 | 20 | 75 | 160 | 0.18 | ◎ | ◎ | ◎ | ◎ |

TABLE 4

| | Winding angle (°) | Wound hardness | Reelability | False twistability | Textured yarn dye quality | Overall evaluation |
|---|---|---|---|---|---|---|
| Example 13 | 18 | 84 | ◎ | ◎ | ◎ | ◎ |
| Example 14 | 21 | 84 | ◎ | ◎ | ◎ | ◎ |

INDUSTRIAL APPLICABILITY

A drawn yarn pirn of the invention may be applied to achieve higher false twisting speed. The PTT drawn yarn exhibits excellent false twistability at high speed, and the resulting textured yarn has satisfactory crimp properties and dye quality suitable for clothing.

The drawn yarn pirn production process according to the invention is a two-stage production process for PTT fiber, i.e. it is a production process comprising spinning/undrawn yarn winding and subsequent drawing, wherein the drawing tension during drawing and ballooning tension during winding are specified, and the drawn yarn is aged under specific conditions. The process yields a drawn yarn with excellent false twistability.

What is claimed is:

1. A drawn yarn pirn characterized in that poly (trimethylene terephthalate) drawn yarn composed of at least 95 mole percent of a trimethylene terephthalate repeating unit and no greater than 5 mole percent of another ester repeating unit, having an intrinsic viscosity of 0.7–1.3 dl/g and satisfying the following conditions (1) to (3), is wound at a wound hardness of 80–90;

(1) A heat shrinkage stress-exhibiting initial temperature of 55° C. or higher (2) A heat shrinkage stress extreme temperature of 150–190° C.

(3) A breaking elongation of 36–60%.

2. A drawn yarn pirn according to claim 1, wherein the breaking elongation of the drawn yarn is 43–60%.

3. A drawn yarn pirn according to claim 2, characterized in that the heat shrinkage stress-exhibiting initial temperature of the drawn yarn is 60–80° C. and the extreme temperature is 155–170° C.

4. A drawn yarn pirn according to claim 1, characterized in that the heat shrinkage extreme stress of the drawn yarn is 0.13–0.21 cN/dtex, and the drawn yarn is wound at a winding angle of 15–21°.

5. A drawn yarn pirn according to claim 4, wherein the breaking elongation of the drawn yarn is 43–60%.

6. A drawn yarn pirn according to claim 5, characterized in that the heat shrinkage stress-exhibiting initial temperature of the drawn yarn is 60–80° C. and the extreme temperature is 155–170° C.

7. A process for producing a drawn yarn pirn characterized in that undrawn yarn made of poly(trimethylene terephthalate) composed of at least 95 mole percent of a trimethylene terephthalate repeating unit and no greater than 5 mole percent of another ester repeating unit and having an intrinsic viscosity of 0.7–1.3 dl/g is first wound and then drawn to produce a drawn yarn pirn, the process satisfying the following conditions (1) to (3);

(1) The drawing tension is 0.20–0.30 cN/dtex (2) The ballooning tension during winding of the pirn is 0.03–0.20 cN/dtex (3) The drawn yarn is aged for at least 10 days in an atmosphere at 25–45° C.

8. A process for producing a drawn yarn pirn according to claim 7, characterized in that the relaxation during winding of the pirn is 2–5%.

* * * * *